US006015150A

United States Patent [19]

Giguère

[11] Patent Number: 6,015,150

[45] **Date of Patent: *Jan. 18, 2000**

[54] THREE-DIMENSIONAL PUZZLE ASSEMBLY

[76] Inventor: Marcel Giguère, 102, rue de l'Esplanade, Saint-Philémon, Québec, Canada, G0R 4A0

[ * ] Notice: This patent issued on a continued prosecution application filed under 37 CFR 1.53(d), and is subject to the twenty year patent term provisions of 35 U.S.C. 154(a)(2).

[21] Appl. No.: 08/937,148

[22] Filed: Sep. 24, 1997

[51] Int. Cl.[7] ..... A63F 9/12

[52] U.S. Cl. ..... 273/157 R; 273/156; 446/88

[58] Field of Search ..... 273/153 R, 156, 273/157 R; 446/124, 125, 88

[56] References Cited

U.S. PATENT DOCUMENTS

| | | | |
|---|---|---|---|
| 1,381,957 | 6/1921 | Anderson | 273/157 R |
| 1,573,358 | 2/1926 | Ross | 273/157 R |
| 2,957,251 | 10/1960 | Nystad et al. | 273/157 R |
| 2,987,318 | 6/1961 | Ahmmer | 273/157 R |
| 3,578,331 | 5/1971 | DeGast | 273/157 R |
| 3,704,892 | 12/1972 | Moravick et al. | 273/157 R |
| 3,851,884 | 12/1974 | Myller | 273/157 R |
| 4,037,846 | 7/1977 | Zeeman | 273/157 R |
| 4,192,509 | 3/1980 | Singh | 273/157 R |
| 4,206,922 | 6/1980 | Keane | 273/157 R |
| 4,371,166 | 2/1983 | Ferris et al. | 273/157 R |
| 4,453,715 | 6/1984 | Halpera | 273/153 S |
| 4,469,331 | 9/1984 | Rinker | 273/157 R |
| 4,494,935 | 1/1985 | Miller | 273/157 R |
| 4,874,176 | 10/1989 | Auerbach | 273/157 R |
| 5,104,125 | 4/1992 | Wilson | 273/157 R |
| 5,165,689 | 11/1992 | Forsse et al. | 273/157 R |
| 5,251,900 | 10/1993 | Gallan | 273/157 R |
| 5,350,331 | 9/1994 | Glickman | 446/126 |
| 5,351,957 | 10/1994 | Scott | 273/157 R |
| 5,441,262 | 8/1995 | Figone et al. | 273/157 R |
| 5,452,895 | 9/1995 | Ray | 273/153 S |
| 5,544,882 | 8/1996 | Sarkar | 273/157 R |
| 5,840,377 | 11/1998 | Donnell | 273/157 R |

FOREIGN PATENT DOCUMENTS

| | | |
|---|---|---|
| 2022198 | 1/1922 | Canada . |
| 2057064 | 11/1990 | Canada . |
| 2096499 | 11/1993 | Canada . |
| 2112727 | 7/1995 | Canada . |

*Primary Examiner*—Steven Wong

*Attorney, Agent, or Firm*—Goudreau Gage Dubuc & Martineau Walker

[57] ABSTRACT

A three-dimensional puzzle assembly comprising a structural portion and a decorative portion is described herein. The structural portion includes a plurality of structural elements that may be assembled to form a predetermined three-dimensional shape. The structural elements include first connectors. The decorative portion includes a plurality of decorative elements made of resilient material and provided with a front decorative surface and a reverse surface. The reverse surfaces are provided with at least one second connector configured, positioned and sized to connect with the first connector to therefore removably interconnect the decorative elements and the structural elements. A wall mounting assembly to support a three-dimensional puzzle assembly is also described herein.

23 Claims, 13 Drawing Sheets

THREE-DIMENSIONAL PUZZLE ASSEMBLY

FIELD OF THE INVENTION

The present invention relates to puzzles. More specifically, the present invention relates to three-dimensional puzzles.

BACKGROUND OF THE INVENTION

Three-dimensional puzzles may take many forms and shapes, many of which are well known in the art. A common characteristic of three-dimensional puzzles is that the assembled puzzle defines a three-dimensional shape that may be displayed much like a sculpture.

U.S. Pat. No. 4,874,176 issued on Oct. 17, 1989 to Auerbach and entitled: "THREE-DIMENSIONAL PUZZLE" describes a puzzle where each individual puzzle piece includes at least one surface defining a sculpted form. A base is provided to support the puzzle pieces during and after the assembly process. Many securing elements are described to secure the puzzle pieces to the base.

U.S. Pat. No. 5,165,689 issued on Nov. 24, 1992 to Forsee et al. and entitled: "THREE-DIMENSIONAL JIGSAW PUZZLE SCULPTURE" describes a three-dimensional puzzle comprising a frame provided with a channel. Puzzle pieces are assembled in the frame within the channel.

U.S. Pat. No. 5,251,900 issued on Oct. 12, 1993 to Gallant and entitled: "THREE-DIMENSIONAL PUZZLE STRUCTURE" describes a three-dimensional puzzle for creating a selfstanding building structure.

A common disadvantage of the three-dimensional puzzles of the prior art is that the assembled puzzles may only be used as decorations or must be disassembled for storage.

Another disadvantage or the three-dimensional puzzles of the prior art is that they may not easily form three-dimensional objects provided with curved surfaces from flat puzzle pieces that may housed in a relatively small box.

OBJECTS OF THE INVENTION

An object of the present invention is therefore to provide an improved three-dimensional puzzle assembly free of the above noted drawbacks of the prior art.

SUMMARY OF THE INVENTION

More specifically, in accordance with the present invention, there is provided a three-dimensional puzzle assembly comprising:

a structural portion including at least one structural element provided with a plurality of first interconnecting means; the structural portion defining a predetermined three-dimensional shape;

a decorative portion including a plurality of decorative elements provided with a front decorative surface and a reverse surface; the reverse surface of each decorative element being provided with at least one second interconnecting means; each second interconnecting means being so configured as to interconnect with one of the first interconnecting means to thereby releasably maintain the decorative element to the structural element.

According to another aspect of the present invention, there is provided a kit of parts for forming a three-dimensional puzzle, the kit of parts comprising:

at least one structural element provided with a plurality of first interconnecting means;

a plurality of decorative elements provided with a front decorative surface and a reverse surface; the reverse surface of each puzzle piece being provided with at least one second interconnecting means; each second interconnecting means being so configured as to interconnect with one of the first interconnecting means to thereby releasably maintain the puzzle element to the structural element.

According to yet another aspect of the present invention, there is provided a puzzle assembly comprising:

a structural portion including at least one structural element provided with a plurality of first interconnecting means; the structural portion defining a predetermined shape;

a decorative portion including a plurality of decorative elements provided with a front decorative surface and a reverse surface; the reverse surface of each the decorative element being provided with at least one second interconnecting means; each second interconnecting means being so configured as to interconnect with one of first interconnecting means to thereby releasably maintain the decorative element to the structural element.

According to another aspect of the present invention, there is provided a wall mounting assembly for supporting a three-dimensional puzzle, the wall mounting assembly comprising:

a structural portion including at least one structural element provided with a plurality of first interconnecting means; the structural portion defining a predetermined shape;

a decorative portion including a plurality of decorative elements provided with a front decorative surface and a reverse surface; the reverse surface of each the decorative element being provided with at least one second interconnecting means; each second interconnecting means being so configured as to interconnect with one of first interconnecting means to thereby releasably maintain the decorative element to the structural element; and means for supporting a three-dimensional puzzle; the support means being mounted to the structural portion and including a distal end to which a three-dimensional puzzle is removably mounted.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Turning now to FIGS. 1–8, a three-dimensional puzzle assembly according to a first embodiment of the present invention will be described. This first embodiment is generally referred to as a closed structure concept as will be apparent upon reading of the following description.

Figure 1:
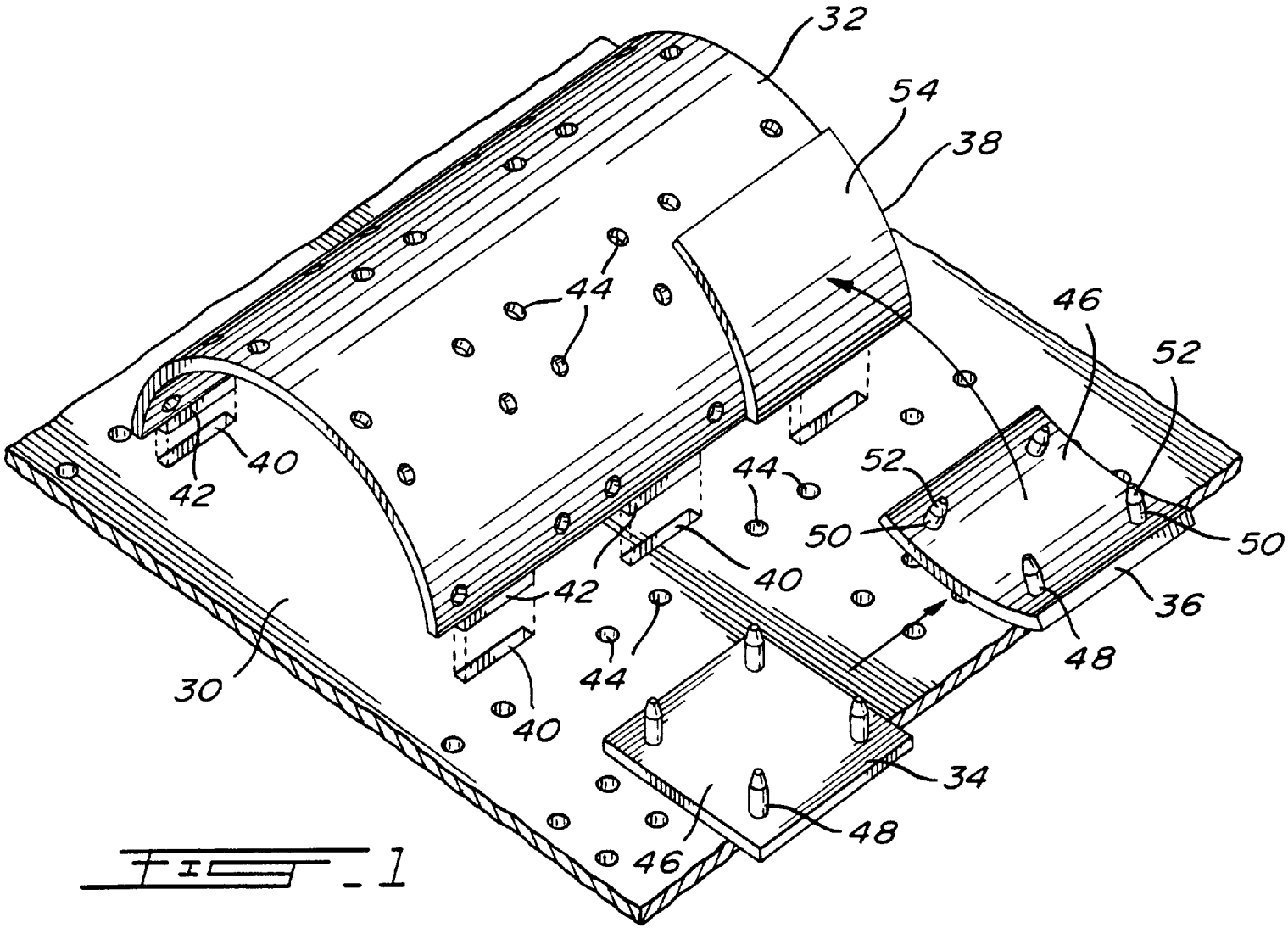
FIG. 1 is a perspective view illustrating an embodiment of the three-dimensional puzzle assembly according to the present invention.

FIG. 1 is a perspective view that illustrates the basic principle of assembly of the various elements forming the first embodiment of the present invention. This figure illustrates a first structural element 30, a second structural elements 32 and three flat decorative elements 34, 36 and 38, hereinafter referred to as puzzle pieces.

The first structural element 30 includes rectangular apertures 40 and the second structural element 32 includes corresponding rectangular projections 42 configured positioned and sized to enter the apertures 40 to therefore maintain the second structural element 32 in its arcuate position. Indeed, the second structural element 32 is advantageously made of a flat piece of a resilient material that may be bent to the semi-cylindrical shape illustrated in FIG. 1.

It is to be noted that the shape and position of the apertures 40 and of the projections 42 are not critical. Indeed, as long as these structural interconnecting members adequately and releasably interconnect the various structural elements, their configuration, size and number may vary widely.

The first and second structural elements 30, 32 are provided with a plurality of circular apertures 44 and the reverse surface 46 of the puzzle pieces 34–38 are provided with corresponding projections 48 having an external diameter similar in size to the apertures 44 to allow the projections 48 to snugly fit in the apertures 44. Each projection 48 defines a cylindrical portion 50 and a frusto-conical portion 52 provided to facilitate the insertion of the projections 48 in the apertures 44.

Again, it is to be noted that the shape and position of the apertures 44 and of the projections 48 are not critical. Indeed, as long as these interconnecting members adequately and releasably interconnect the decorative element to the various structural elements, their configuration, size and number may vary widely.

The puzzle pieces 34–38 are provided with respective decorative surfaces 54 that are visible when the decorative elements are mounted to the structural elements. The puzzle pieces are therefore similar to conventional puzzle pieces since they are so decorated that a predetermined visual aesthetic is achieved when all the decorative elements are adequately mounted to the structural elements. Of course, the number of decorative elements varies with the size, configuration and complexity of the three-dimensional puzzle assembly.

As can be seen from FIG. 1, the puzzle pieces 34–38 are made of a flat piece of a resilient material that may be bent to the shape illustrated in FIG. 1.

Figure 2:
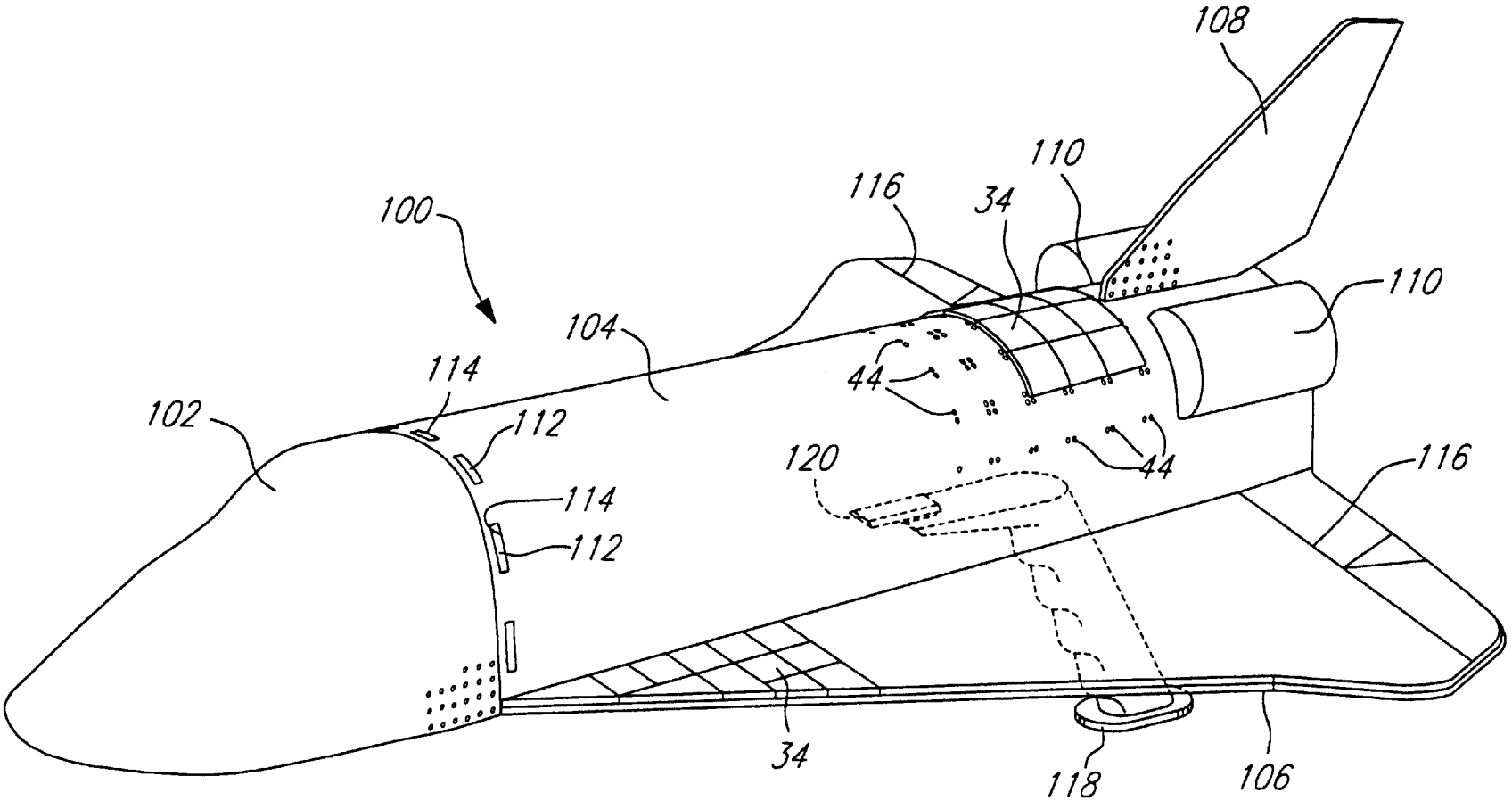
FIG. 2 is a perspective view illustrating a space shuttle puzzle/toy made according to the general principles of the three-dimensional puzzle assembly of FIG. 1.

Turning now to FIG. 2 of the appended drawings, the general closed concept of the three-dimensional puzzle assembly according to the first embodiment of the present invention will be further described with respect to an example of three-dimensional puzzle assembly forming a space shuttle puzzle/toy 100. It is to be noted that the space shuttle puzzle/toy 100 illustrated in FIG. 2 is partially assembled.

The space shuttle 100 includes a structural portion including a plurality of structural elements 102, 104, 106, 108 and 110 respectively forming the cabin, body, wings (only one shown), rudder assembly and engines. The structural elements are interconnected via structural interconnecting members. For example, the cabin 102 includes rectangular projections 112 and the body 104 includes corresponding rectangular apertures 114 allowing the body and the cabin to be assembled.

As can be seen from FIG. 2, the structural elements include a plurality of circular apertures 44.

The space shuttle puzzle/toy 100 also includes a decorative portion including a plurality of decorative elements under the form of puzzle pieces 34 provided with cylindrical projections (see FIG. 1) configured and sized to be inserted into the circular apertures 44 for semi-permanent assembly. The decorative front surfaces of the puzzle pieces 34 are provided with drawings imitating the elements of an actual space shuttle, such as, for example, the lines 116 simulating the elevons.

To assemble the space shuttle 100, the user would therefore generally follow the steps listed hereinbelow:

assemble the structural elements 102–110 to form the structure of the shuttle; and assemble the puzzle pieces on the structural elements to form the decorated space shuttle puzzle/toy.

The first step is not particularly challenging because of the relatively low number of structural elements. However, the complexity of the second step varies with the number of puzzle pieces and with the level of similarity between different puzzle pieces.

It is to be noted that the level of complexity of the above noted second step may be tailored according to the intended user. For example, if the particular three-dimensional puzzle assembly is intended for young users, the puzzle pieces may be larger than illustrated and the outline of the decoration present on the decorative surface of the puzzle piece may be reproduced onto the structural elements (not shown). On the other hand, if the three-dimensional puzzle assembly is intended for adult users, the puzzle pieces may be smaller than illustrated and the structural elements are left blank as shown in the appended drawings.

FIG. 2 also illustrates a handle 118 including a projecting rectangular attachment portion 120 that may be inserted in a corresponding aperture (not shown) of the underside of the body 104 to releasably connect the handle 118 to the structural portion of the shuttle 100. The user may thus grab the handle 118 to play with the shuttle 100.

It is to be noted that FIG. 2 also illustrates puzzle pieces that are not square, for example the puzzle pieces forming the edges of the wing 106.

Figure 3:
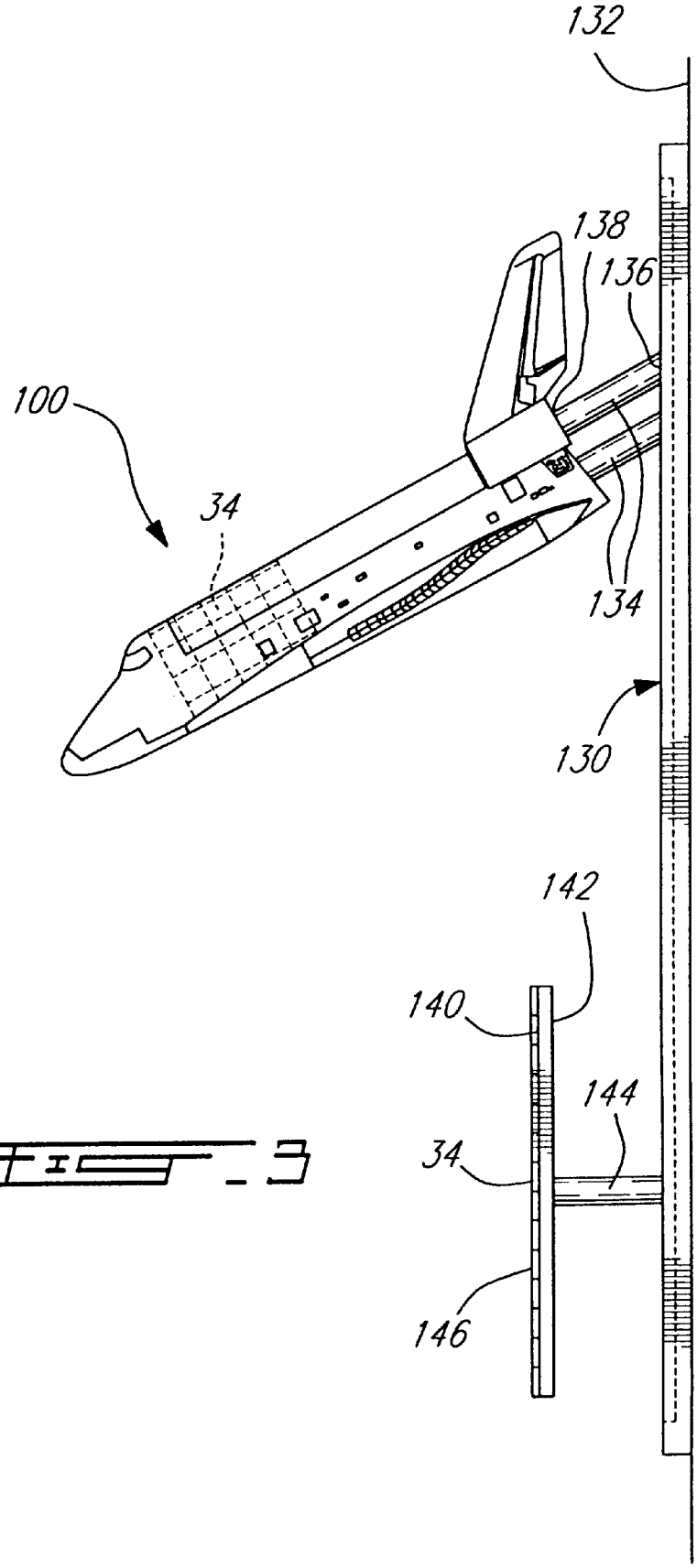
FIG. 3 is a side elevational view illustrating the space shuttle puzzle/toy of FIG. 2 mounted to a wall mounting assembly.

Turning now to FIG. 3 of the appended drawings, the space shuttle puzzle/toy 100 is illustrated mounted to a wall mounting assembly 130 that is mounted to a wall 132.

The shuttle 100 is mounted to the wall mounting assembly 130 via three wall mounting elements 134 (only two shown) each provided with a proximate end 136 releasably connected to the wall mounting assembly 130 and a distal end 138 releasably connected to a rear portion of the shuttle 100.

Other bi or three-dimensional elements such as, for example, the bi-dimensional decorative assembly 140, may be mounted to the wall mounting assembly 130. In this case, the decorative assembly 140 could represent an illustration of the instrument panel (not shown) of the actual space shuttle. The decorative assembly 140 includes a structural portion 142 mounted to the wall mounting assembly 130 via a wall mounting element 144. The decorative assembly 140 also includes a decorative portion 146 formed of a plurality of puzzle pieces 34 that, when assembled properly, illustrate the above mentioned instrument panel.

Figure 4:
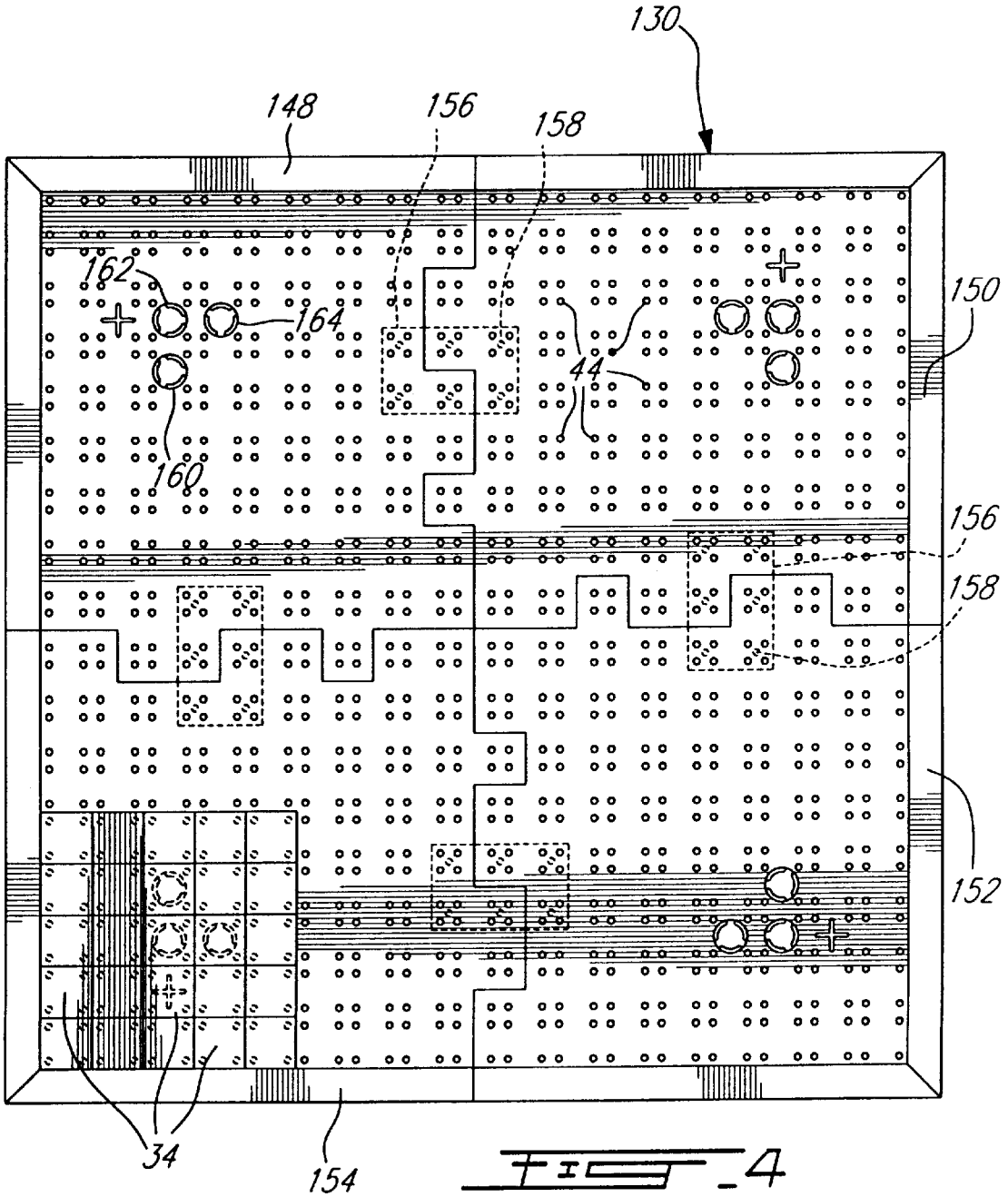
FIG. 4 is a front elevational view illustrating the wall mounting assembly of FIG. 3.

As can be better seen from FIG. 4, the wall mounting assembly 130 includes a structural portion under the form of four identical structural elements 148, 150, 152 and 154 having their rear surfaces interconnected via flat connectors 156. These connectors 156 are provided with projections 158 cooperating with apertures (not shown) of the rear surface of adjacent structural elements. Of course, the structural elements 148–154 could be interconnected by other means.

The structural elements 148–154 include a plurality of circular apertures 44 positioned to receive the cylindrical projections 48 of puzzle pieces 34 forming the decorative portion of the wall mounting assembly 130. When the puzzle pieces 34 are properly assembled onto the structural elements 148–154, the front surfaces of the puzzle pieces form a picture. For example, to be in the space shuttle theme, the picture could represent the lunar surface.

Each structural element 148–154 also includes three larger circular apertures 160, 162 and 164 configured and sized to receive and to releasably maintain the proximate ends of the wall mounting elements 134 and 144.

Figure 5:
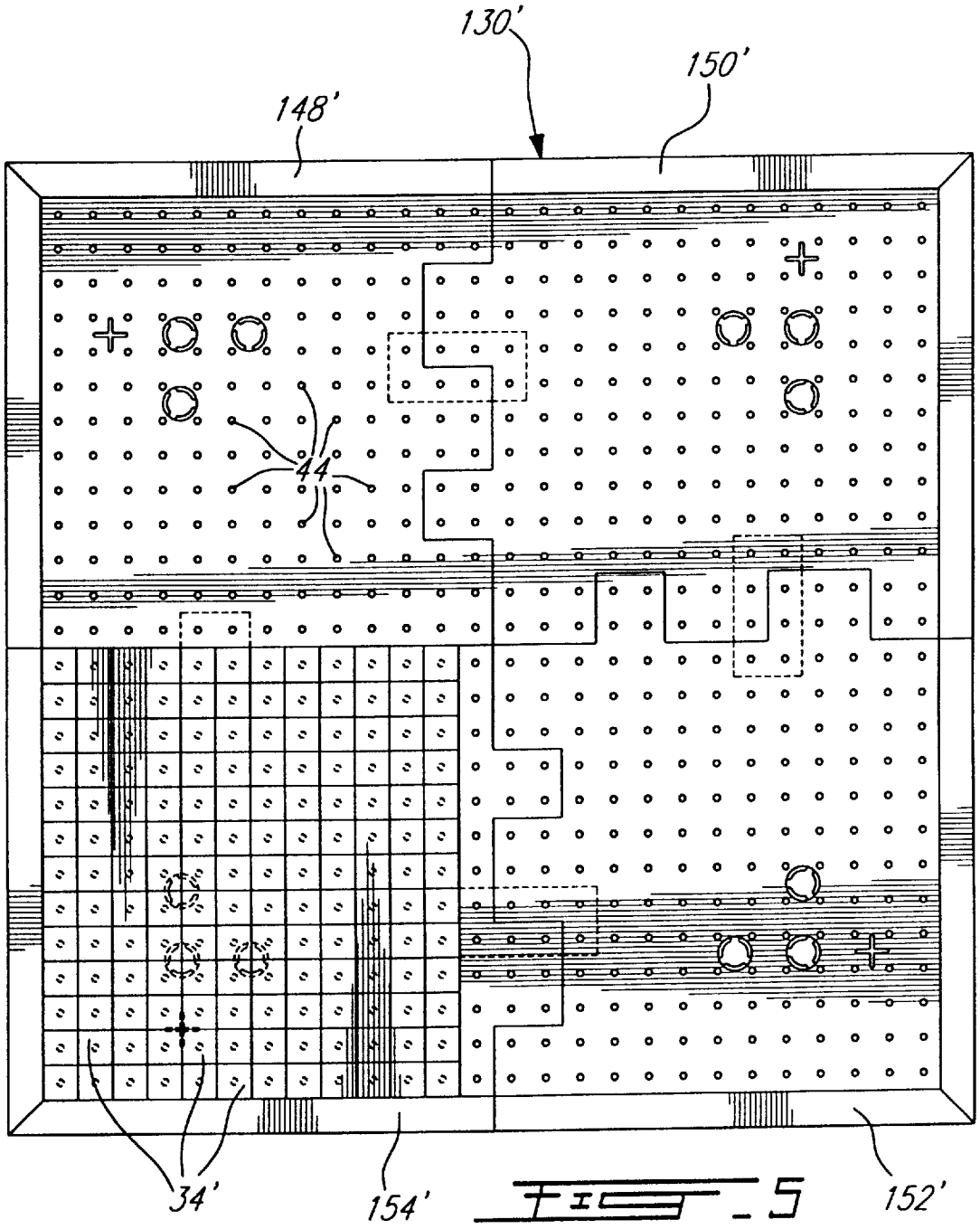
FIG. 5 is a front elevational view illustrating an alternative to the wall mounting assembly of FIG. 3.

Turning now to FIG. 5 of the appended drawings, an alternative wall mounting assembly 130' will be described.

The wall mounting assembly 130' is very similar to the wall mounting assembly 130 of FIG. 4 but illustrates another configuration of the positions of the circular apertures 44 in the structural elements 148'–154'. Indeed, the circular apertures 44 are so positioned that the puzzle pieces 34' used are provided with only a centrally positioned cylindrical projection (not shown).

Figure 6:
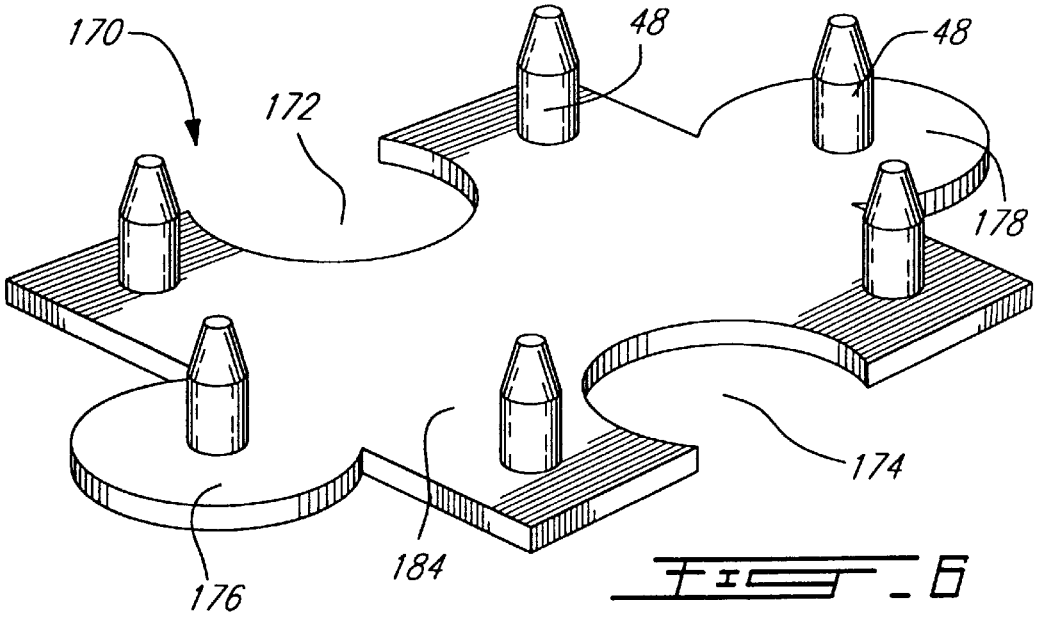
FIG. 6 is a perspective view illustrating a decorative puzzle piece having a conventional puzzle piece shape.
Figure 7:
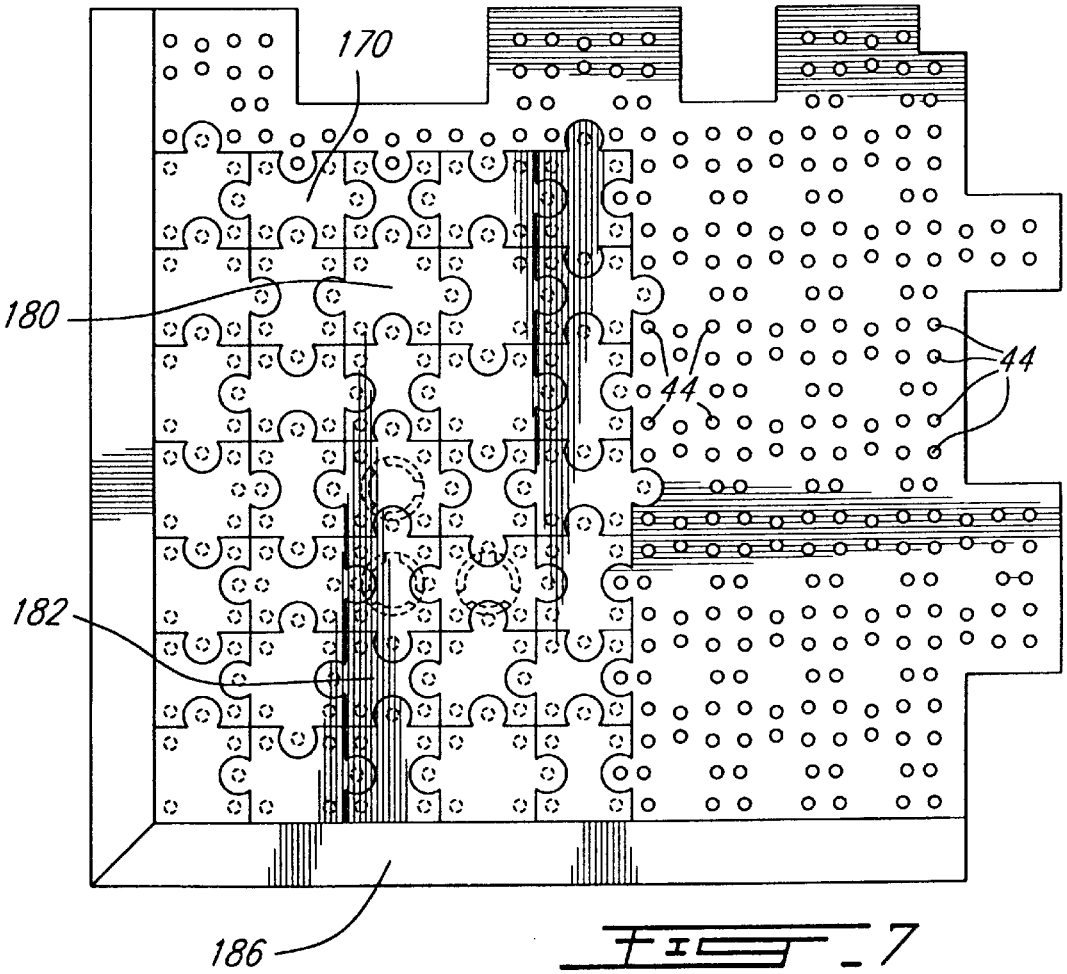
FIG. 7 is a front elevational view illustrating a portion of an alternative wall mounting assembly designed to receive a plurality of the puzzle pieces shown in FIG. 6.

FIG. 6 of the appended drawings illustrates an alternative puzzle piece 170 having a more conventional puzzle piece shape. Indeed, the puzzle piece 170 has two cutouts 172,174 and two wing extensions 176,178. Of course, as can be seen in FIG. 7, similar puzzle pieces could be provided with different numbers and configurations of cutouts and wing extensions to better simulate a conventional puzzle. For example, puzzle piece 180 includes three wings and one cutout and puzzle piece 182 includes one wing and three cutouts.

Returning to FIG. 6, the reverse surface 184 of the puzzle piece 170 is provided with six cylindrical projections 48 as described hereinabove. The two additional projections 48 are provided under the wings 176 and 178 to adequately maintain the wings in place on the structural elements.

FIG. 7 illustrates a structural element 186 of a wall mounting assembly. The structural element 186 is provided with a plurality of circular apertures 44 positioned to allow the insertion of the puzzle pieces 170, 180, 182 and the like. It is to be noted that the structural element illustrated in FIG. 7 may also receive the squared puzzle pieces illustrated in FIGS. 1–4.

It is also to be noted that, although not shown in the appended drawings, puzzle pieces similar to the puzzle piece 170 could be used on a three-dimensional puzzle assembly such as the space shuttle puzzle/toy 100.

Figure 8:
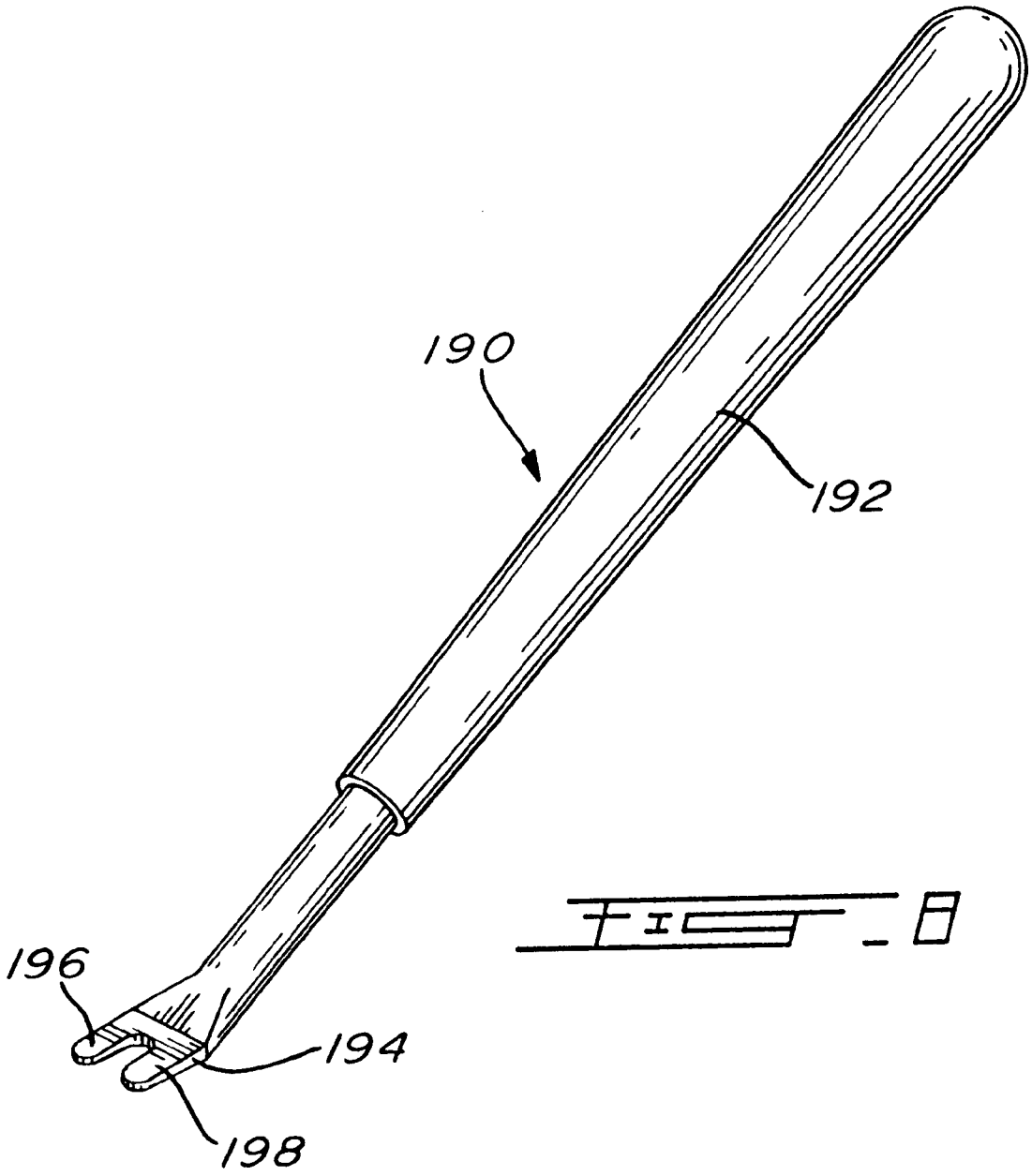
FIG. 8 is a perspective view of a tool used to disassemble the puzzle pieces from the structural pieces.

A tool 190 for disassembling the puzzle pieces from the structural elements is illustrated in FIG. 8. The tool 190 includes a handle 192 and a two prong forked distal end 194. To disassemble the puzzle pieces from the structural elements, the forked distal end 194 is inserted under a particular puzzle piece so that the two prongs 196 and 198 are positioned on either sides of one of the cylindrical projection 48 of the puzzle piece. The tool 190 is then pivoted to cause the particular projection 48 to egress the circular opening 44 of the structural element.

Turning now to FIGS. 9–19 of the appended drawings, a second embodiment of the three-dimensional puzzle assembly according to the present invention will be described. Again, a space shuttle puzzle/toy 200 will be used as an example to illustrate the various features and advantages of this second embodiment.

The general concept of the second embodiment is generally referred to an opened structure concept since, as will be apparent from the following description, the various elements forming the structure portion of the three-dimensional puzzle assembly form an opened structure, when assembled, compared to the closed structure illustrated in FIG. 2, for example.

Figures 9, 9A:
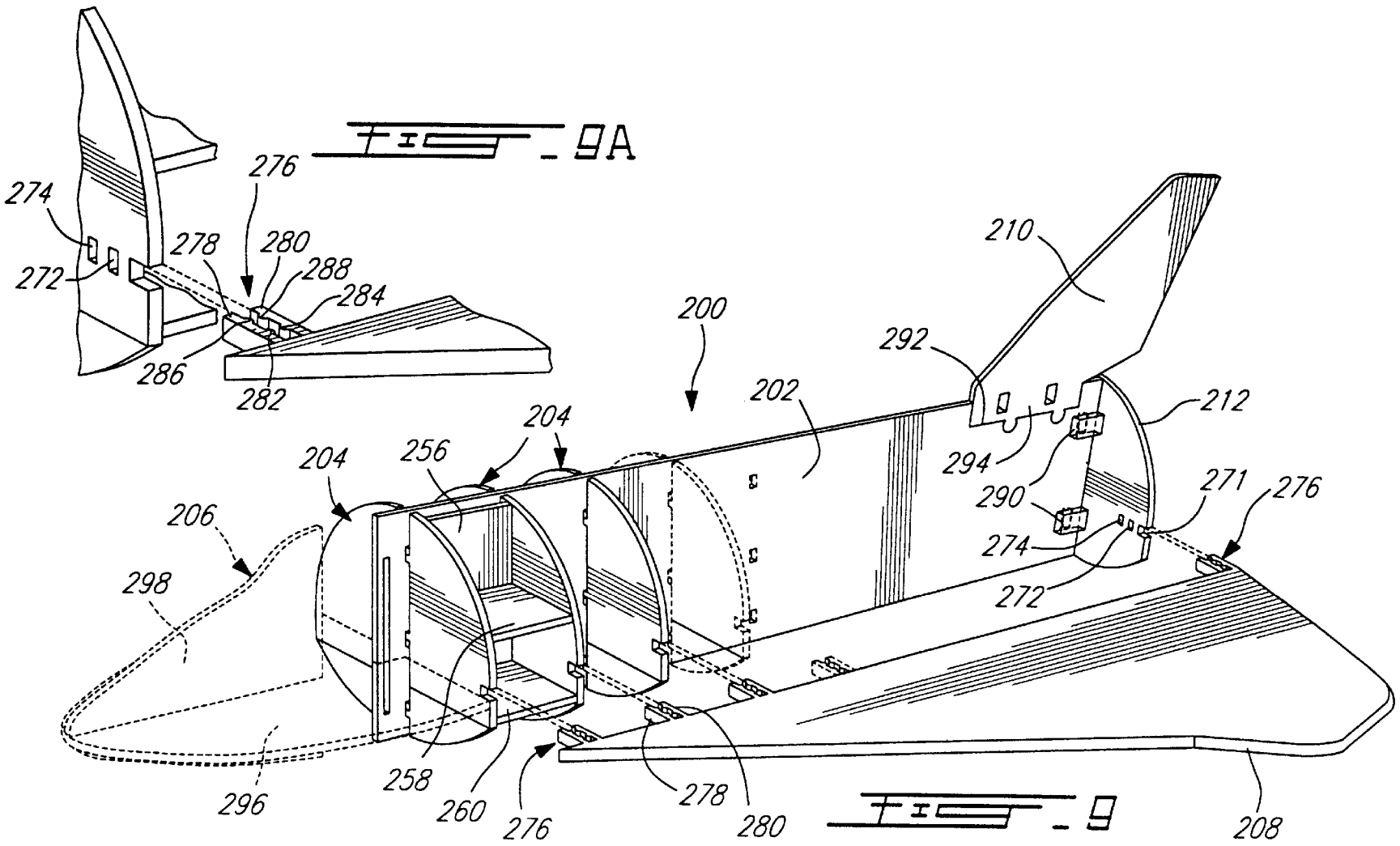
FIG. 9 is a schematized perspective view illustrating the structural portion of a space shuttle puzzle/toy according to a second embodiment of the three-dimensional puzzle assembly of the present invention.
FIG. 9A is an enlargement of a portion of FIG. 9.

FIG. 9 schematically illustrates the structural portion of the space shuttle puzzle/toy 200 that includes a central longitudinal support 202, a plurality of rib support assemblies 204, a cabin support assembly 206, a pair of wings 208 (only one shown), a rudder 210 and an end support 212.

The rib support assemblies 204, the cabin support assembly 206 the rudder 210 and the end support 212 are mounted to the central support 202, while the wings 208 are mounted to the rib support assemblies 204. The interconnecting members for interconnecting the various structural elements will be described hereinbelow.

Figure 10:
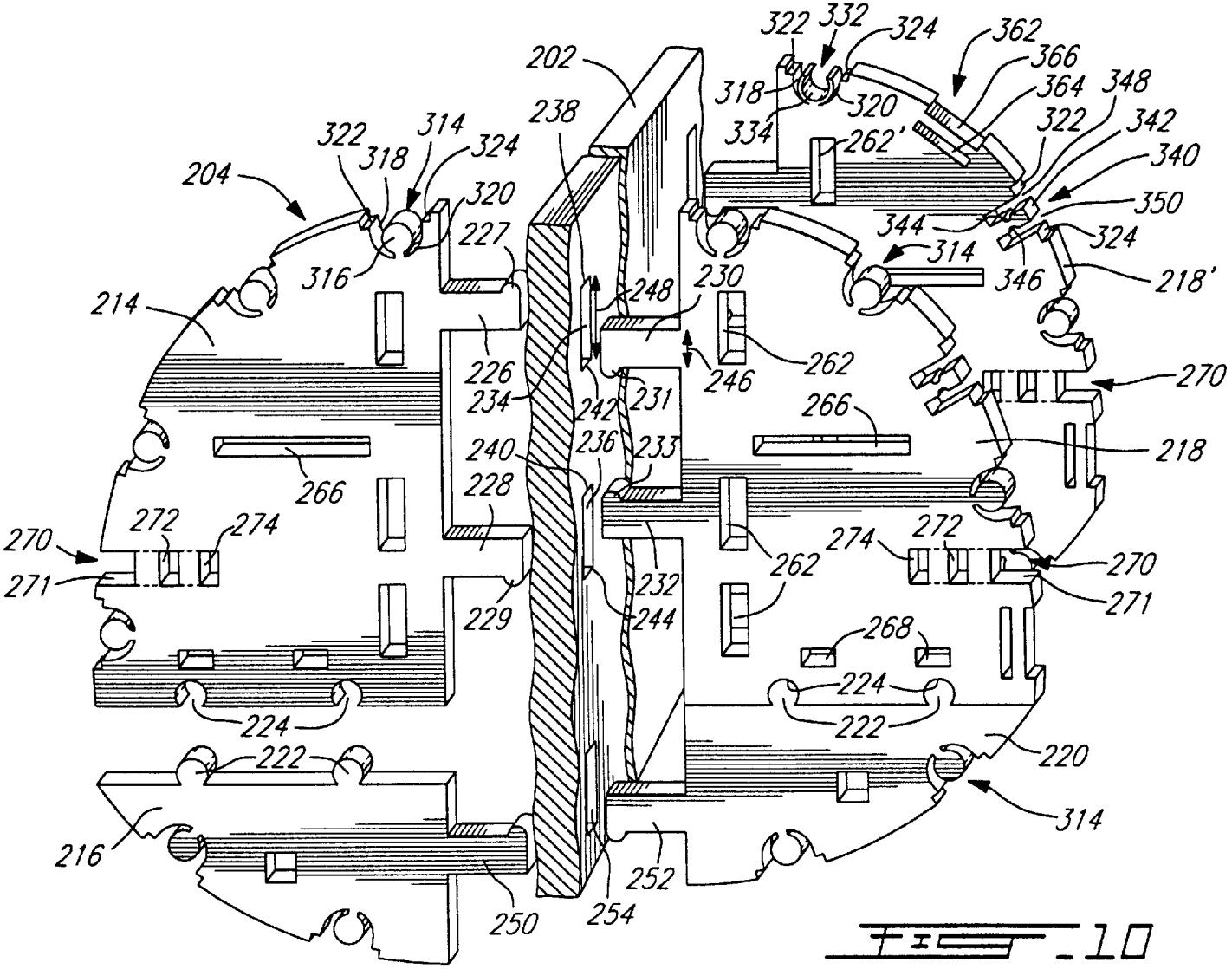
FIG. 10 is a perspective view illustrating a central support and rib portions of the space shuttle of FIG. 9.

Turning now to FIG. 10 of the appended drawings, one rib support assembly 204 will be more fully described. The rib support assembly 204 includes a first upper rib portion 214, a first lower rib portion 216, a second upper rib portion 218 and a second lower rib portion 220.

The first and second lower rib portions 216 and 220 include cylindrical projections 222 and the first and second upper rib portions 214 and 218 include corresponding cylindrical cutouts 224. Second upper and lower rib portions 218 and 220 are shown attached via projections 222 and cutouts 224.

The upper rib portion 214 includes structural interconnecting members under the form of first and second laterally projecting generally L-shaped connectors 226, 228 provided with respective beads 227, 229 while the upper rib portion 218 includes structural interconnecting members under the form of third and fourth laterally projecting generally L-shaped connectors 230, 232 provided with respective beads 231, 233. The central support 202 includes structural interconnecting members under the form of first and second rectangular apertures 234, 236 each provided with respective upper edges 238, 240 and lower edges 242, 244. The first and second rectangular apertures 234, 236 are positioned so as to allow the insertion of the L-shaped connectors 226, 228, 230 and 232 therein.

More specifically, (a) the first L-shaped connector 226 is to be inserted in the first aperture 234 so that its bead 227 contacts the upper edge 238 of the first rectangular aperture 234; (b) the second L-shaped connector 228 is to be inserted in the second aperture 236 so that its bead 229 contacts the lower edge 244 of the second rectangular aperture 236; (c) the third L-shaped connector 230 is to be inserted in the first aperture 234 so that its bead 231 contacts the lower edge 242 of the first rectangular aperture 234; and (d) the fourth L-shaped connector 232 is to be inserted in the second aperture 236 so that its bead 233 contacts the upper edge 240 of the second rectangular aperture 236. The contact between the beads and the edges of the rectangular apertures will therefore connect the upper rib portions 214, 218 to the central support 202.

It is to be noted that the height 246 of the connectors 226, 228, 230 and 232 is slightly less than half the height 248 of the apertures 236 and 238 to allow the insertion of two connectors in one aperture.

The lower rib portions 216 and 220 are provided with respective L-shaped connectors 250, 252 configured, positioned and sized to be inserted in a third rectangular aperture 254 of the central support 202 as described hereinabove with respect to the upper rib portions 214 and 218.

Returning briefly to FIG. 9, the structural portion of the space shuttle puzzle/toy 200 includes a vertical lateral support 256 and first and second horizontal supports 258 and 260. These supports are mounted to and between adjacent rib support assemblies 204 to maintain the rib support assemblies 204 in a parallel relationship.

Figure 11:
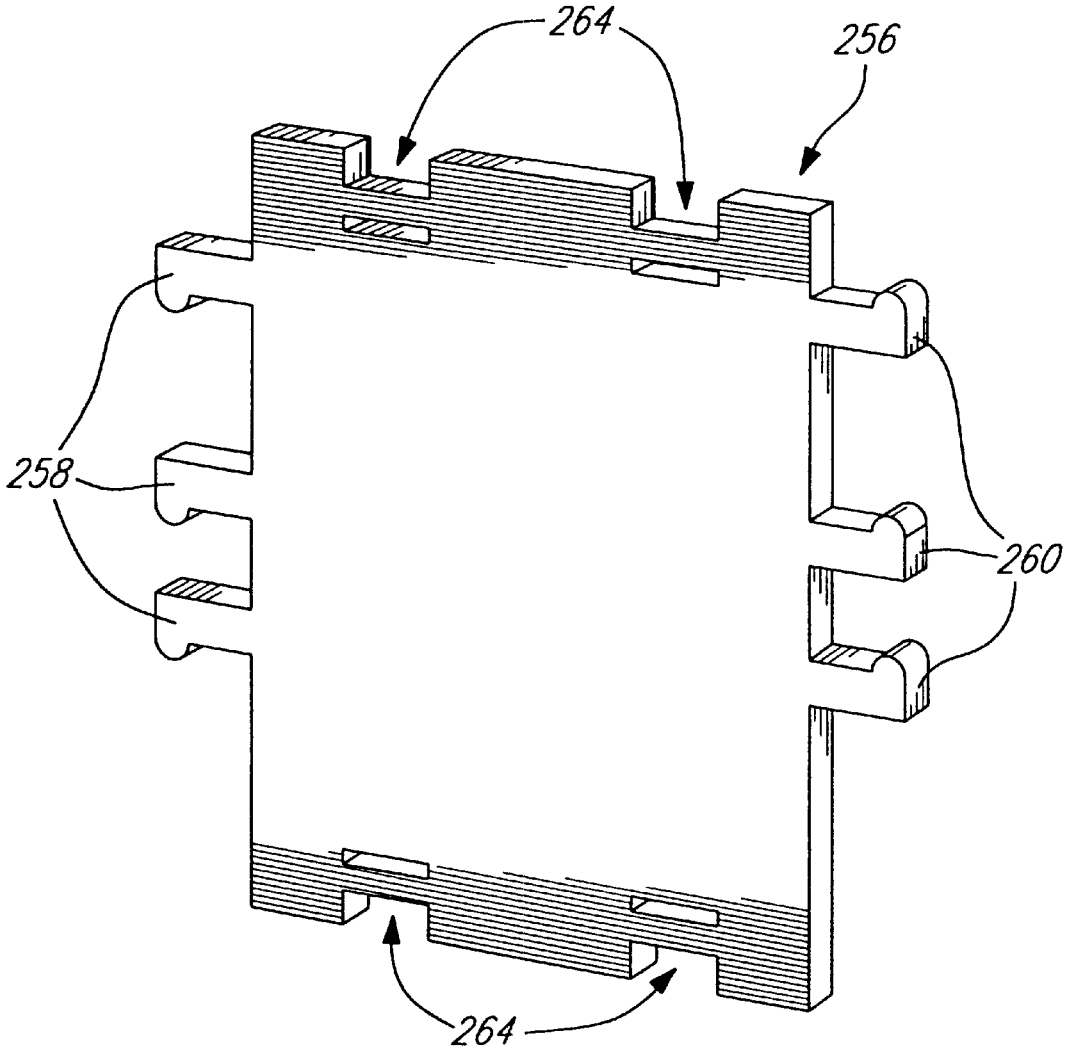
FIG. 11 is a perspective view of a lateral support of the space shuttle of FIG. 9.

FIG. 11 illustrates the vertical lateral support 256 in greater details. Vertical support 256 includes three laterally projecting L-shaped connectors 258 and three laterally projecting L-shaped connectors 260 similar to the connectors 226, 228, 230 and 232 of the rib portions 214 and 218. The connectors 258 are configured, sized and positioned to be inserted in rectangular apertures 262 of a first upper rib portion 218 (see FIG. 10) while the connectors 260 are configured, sized and positioned to be inserted in rectangular apertures 262' of a second adjacent upper rib portion 218'. As discussed hereinabove, each aperture 262, 262' may receive one connector 258 of a first vertical support 256 and one connector 260 of a second adjacent vertical support 256 (not shown in FIG. 9). It is to be noted that the vertical support 256 also includes connecting elements 264 to which the puzzle pieces (not shown) will be connected as will be described hereinbelow.

To illustrate various methods for interconnecting the support elements of the structural portion of the space shuttle puzzle/toy 200, the upper rib portions 214, 218 illustrated are provided with a horizontal rectangular aperture 266 to receive a projecting portion (not shown) of the first horizontal support 258 (FIG. 9) and a pair of rectangular apertures 268 to receive a pair of projecting portions (not shown) of the second horizontal portion 260 (FIG. 9). Of course, other structural interconnecting members could be used as long as the various structural elements are properly and releasably interconnected.

Each upper rib portion 214, 218 is provided with a recessed connector 270 including a rectangular cutout 271 and a pair of aligned rectangular apertures 272, 274. On the other hand, each wing 208 includes a plurality of projecting connectors assemblies 276 including two extensions 278, 280 provided with two pairs of facing beads 282, 284 and 286, 288 (FIGS. 9 and 9A). The facing beads 282, 284 are configured, positioned and sized to be inserted in the rectangular aperture 272 while the facing beads 286, 288 are configured, positioned and sized to be inserted in the rectangular aperture 274. Each wing 208 is therefore releasably connected to the rib assemblies 204.

It is to be noted that the end support 212 is also provided with a rectangular cutout 271 and a pair of rectangular apertures 272, 274 to receive one projecting connector assembly 276 of the wing 208.

The end support 212 is also provided with two projecting connector assemblies 290 similar to the projecting connectors 276. The end of the central support 202 is provided with a rectangular cutout (not shown) similar to the cutout 271 of the rib portions and a pair of rectangular apertures (not shown) similar to the apertures 272, 274 of the rib portions. The end support 212 may thus be removably connected to the central support 202.

Returning to FIG. 9, the central support 202 includes a cutout 292 configured and sized to receive an inner end 294 of the rudder 210. Of course, rib support assemblies 204 will be mounted to the central support on either sides of the inner end 294 (not shown in FIG. 9) to selectively prevent the disassembly of the rudder 210 from the central support 202.

The cabin support assembly 206 is schematically illustrated in FIG. 9. It includes a horizontal support 296 and a vertical support 298. It is believed to be within the reach of one skilled in the art to provide further supports (not shown) connected to the supports 296 and 298 as discussed hereinabove with respect to the rib support assemblies 204, to the vertical support 256 and to the first and second horizontal supports 258 and 260. In general, the cabin support assembly 206 is connected to the central support 202 and optionally to its adjacent rib support assembly 204 by structural interconnecting elements (not shown).

It is to be noted that the structural portion of the space shuttle puzzle/toy 200 of FIG. 9 could be used inside the space shuttle puzzle/toy 100 of FIG. 2 to provide a more solid structure.

Figure 12:
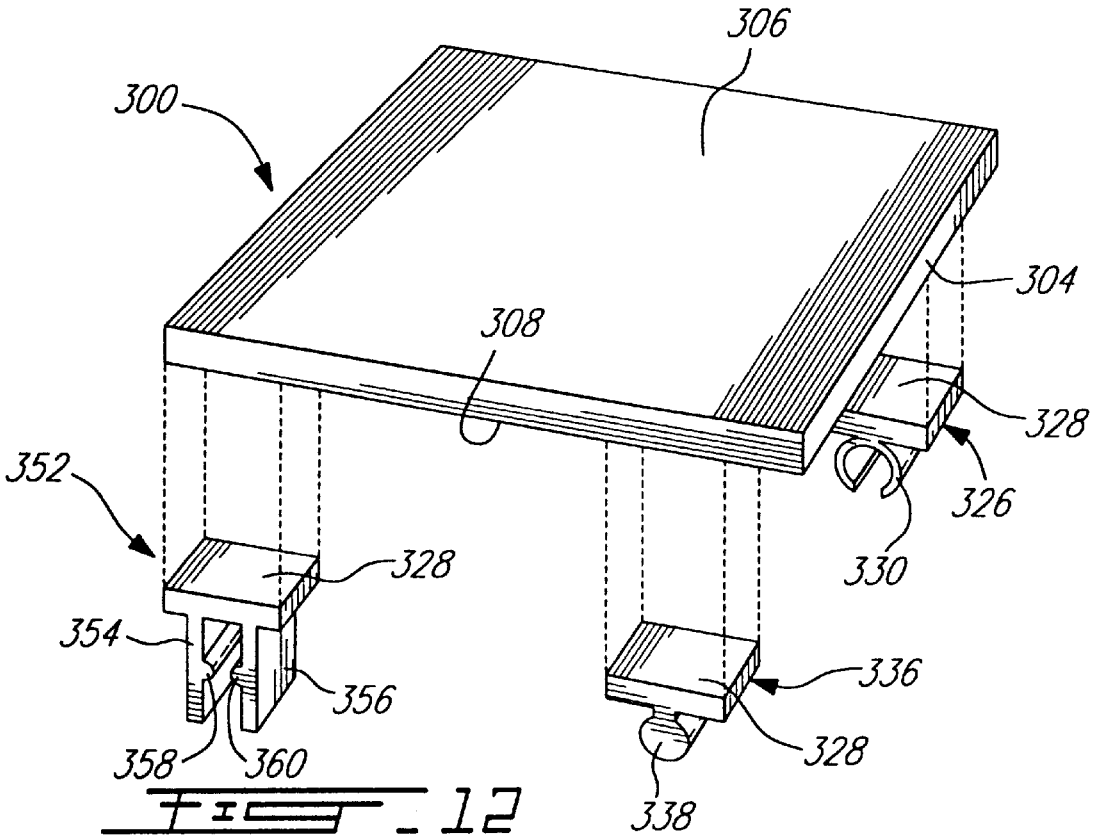
FIG. 12 is a perspective view of a decorative puzzle piece configured to be installed to the structural elements of the shuttle of FIG. 9.
Figure 13:
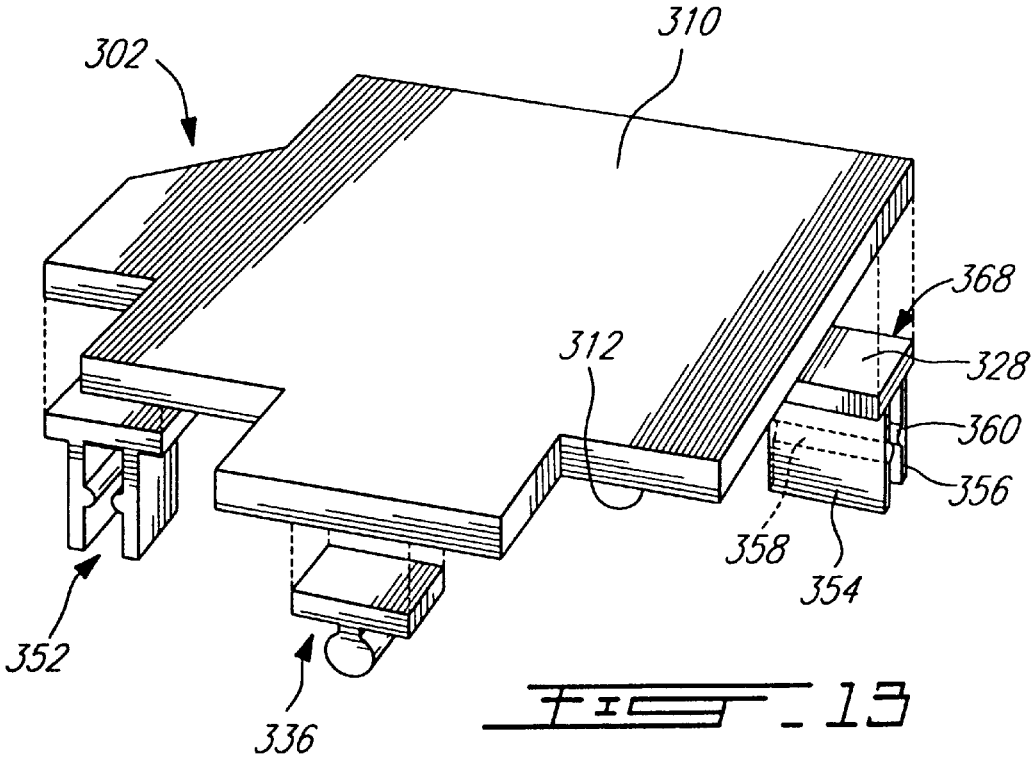
FIG. 13 is a perspective view of an alternative decorative puzzle piece configured to be installed to the structural elements of the shuttle of FIG. 9.

Turning now to FIGS. 10,12 and 13, the space shuttle puzzle/toy assembly 200 also includes a decorative portion formed by a plurality of puzzle pieces such as, for example, puzzle pieces 300 and 302 illustrated in FIGS. 12 and 13, respectively. These puzzle pieces are designed to be mounted to the rib support assemblies 204 and to the cabin support assembly 206 and are therefore advantageously made of an adequately resilient material.

Alternatively, each piece could be made of rigid material shaped to adequately fit to a predetermined position. However, this would dramatically increase the production costs since many molds would have to be designed and operated.

As illustrated in FIG. 12, the puzzle piece 300 includes a generally flat resilient portion 304 provided with a decorative front surface 306 and a reverse surface 308 usually not visible when the puzzle piece 300 is mounted to the structural portion of the puzzle/toy. At least one projecting connecting element is mounted to the reverse surface 308 of the puzzle piece 300.

The puzzle piece 302 illustrated in FIG. 13 has a decorative front surface 310 that is similar in shape to a conventional puzzle piece. Again, at least one projecting connecting element is mounted to the reverse surface 312 of the puzzle piece 302.

The projecting connecting elements mounted to the reverse surfaces 308 and 312 of the puzzle pieces 300 and 302 are of various configurations that will be further explained hereinafter.

As can be seen from FIG. 10 the peripheral edges of the upper and lower rib sections 214, 216, 218 and 220 are provided with recessed connecting elements of various configurations. These recessed connecting elements and the projecting connecting elements of the puzzle pieces are associated in pair so that each configuration of projecting connecting elements may be interconnected with one configuration of recessed connecting elements.

For illustrative purposes, four types of corresponding pairs of recessed/projecting connecting elements are shown in FIGS. 10, 12 and 13 and will be explained hereinafter.

A first type of recessed connecting element 314 includes a cylindrical connector 316, a pair of outwardly flaring cutouts 318, 320 and a pair of shoulders 322, 324. The corresponding projecting connecting element 326 (FIG. 12) includes a square base 328 to which is mounted a C-shaped connector 330. The internal diameter of the C-shaped connector 330 is essentially equal to the external diameter of the cylindrical connector 316. When the projecting connecting element 326 is assembled with the recessed connecting element 314, the deformation of the C-shape connector 330 to contact the cylindrical connector 316 is allowed by the flaring cutouts 318, 320. The shoulders 322, 324 are configured and sized to receive the square base 328 so that the reverse surface of the puzzle piece to which the projecting connecting element 326 is connected may rest against the peripheral edge of the support element in which the recessed connecting element 314 is formed.

A second type of recessed connecting element 332 includes a C-shaped connector 334, a pair of outwardly flaring cutouts 318, 320 and a pair of shoulders 322, 324. The corresponding projecting connecting element 336 (FIG. 12) includes a square base 328 to which is mounted a cylindrical connector 338. The internal diameter of the C-shaped connector 334 is essentially equal to the external diameter of the cylindrical connector 338. When the projecting connecting element 336 is assembled with the recessed connecting element 332, the deformation of the C-shape connector 334 to contact the cylindrical connector 338 is allowed by the flaring cutouts 318, 320. The shoulders 322, 324 are configured and sized to receive the square base 328 so that the reverse surface of the puzzle piece to which the projecting connecting element 336 is connected may rest against the peripheral edge of the support element in which the recessed connecting element 334 is formed.

A third type of recessed connecting element 340 includes a rectangular connector 342 provided with opposed transversal channels 344, 346, a pair of cutouts 348, 350 and a pair of shoulders 322, 324. The corresponding projecting connecting element 352 (FIG. 12) includes a square base 328 to which is mounted a pair of parallel connectors 354, 356 provided with respective facing ribs 358, 360. The distance between the connectors 354 and 356 is essentially equal to the width of the rectangular connector 342. When the projecting connecting element 352 is assembled with the recessed connecting element 340, the deformation of the parallel connectors 354, 356, required to cause the contact between the ribs 358, 360 and a respective channel 344, 346, is allowed by the cutouts 348, 350. The shoulders 322, 324 are configured and sized to receive the square base 328 so that the reverse surface of the puzzle piece to which the projecting connecting element 352 is connected may rest against the peripheral edge of the support element in which the recessed connecting element 340 is formed.

A fourth type of recessed connecting element 362 includes a rectangular aperture 364 and a shoulder 366. The corresponding projecting connecting element 368 (FIG. 13) is identical to the projecting connecting element 352 rotated by a ninety degree angle. The connecting element 368 thus includes a square base 328 to which is mounted a pair of parallel connectors 354, 356 provided with respective facing ribs 358, 360. The distance between the connectors 354 and 356 is essentially equal to the thickness of the support element to which it is to be mounted. When the projecting connecting element 368 is assembled with the recessed connecting element 362, the parallel connectors 354, 356 advantageously spread apart to enable the contact between the ribs 358, 360 and the aperture 364. The shoulder 366 is configured and sized to receive the square base 328 so that the reverse surface of the puzzle piece to which the projecting connecting element 368 is connected may rest against the peripheral edge of the support element in which the recessed connecting element 362 is formed.

It is to be noted that other recessed/projecting connecting elements pairs could be designed to releasably connect the puzzle pieces onto the support elements.

It is also to be noted that the number and position of projecting connecting elements mounted to the underside of the puzzle pieces is highly variable and depend of the particular position of the puzzle piece onto the support element.

The user will therefore have two ways for determining the position of a particular puzzle piece onto the structural portion of the three-dimensional puzzle assembly. First, the decoration of the front surface of the puzzle piece gives an indication of the position of the piece onto the structural portion and second, the configuration and position of the projecting connecting elements mounted to the reverse surface of the puzzle piece gives an indication concerning which recessed connecting element must be present to adequately connect the puzzle piece to the structural portion of the three-dimensional puzzle assembly.

Furthermore, since the upper rib portions are interchangeable and the number, position and configuration of the recessed connecting elements may vary from one rib portion to another, the user is faced with the added difficulty that the rib assemblies 204 must be correctly mounted to the central support 202 to succeed in the puzzle assembly. Of course, if an easier three-dimensional puzzle assembly is to be produced, the different rib portions could be marked to indicate their relative or absolute position.

It is to be noted that since the wings 208, the rudder 210 and the visible portion of the end support 212, are flat, the decoration of these elements may be directly applied thereon to decrease the difficulty level to assemble the puzzle/toy. However, since these supports are flat, puzzle pieces as illustrated in FIGS. 1–7 could also be mounted thereon. Of course, if this is the case, adequate circular apertures (not shown) must be provided.

It is also to be noted that while the projecting connecting elements are illustrated in FIGS. 12 and 13 as being separate elements that are glued or otherwise mounted to the reverse surface of the puzzle pieces, these projecting connecting elements could be integrally formed in the underside of the puzzle piece. As will be apparent to one skilled in the art, if this is the case, the shoulders 322, 324 and 366 (FIG. 10) would no longer be advantageous.

It is also to be noted that the peripheral edges of the support portions 296 and 298 as well as the other supports (not shown) of the cabin support assembly 206 advantageously include recessed connecting elements similar to the connecting elements illustrated in FIG. 10 to enable the assembly of puzzle pieces thereto.

As will easily be understood by one skilled in the art, the assembly steps of the space shuttle puzzle/toy 200 are generally similar to the assembly steps of the space shuttle puzzle/toy 100 described hereinabove. Similarly, the difficulty level of the puzzle/toy may be tailored to the intended user.

It is to be noted that a handle (not shown) may be connected to the structural portion of the space shuttle puzzle/toy 200 to use it as a hand-held toy.

Turning now to FIGS. 14–19 of the appended drawings, a wall mounting assembly 400 will be described. The general purpose of the wall mounting assembly 400 is to enable the three-dimensional puzzle assemblies to be displayed while they are not used as toys.

The wall mounting assembly 400 includes a structural portion including a plurality of first support members 402 (see FIG. 17), a plurality of second support members 404 and four frame members 405. The wall mounting assembly 400 also includes a decorative portion including a plurality of puzzle pieces 406 similar to the puzzle pieces 300 and 302 of FIGS. 12 and 13, respectively. Again, the general principle of the present invention is found in the wall mounting assembly since it is made of an assembled structural portion onto which a decorative portion is mounted.

Figure 17:
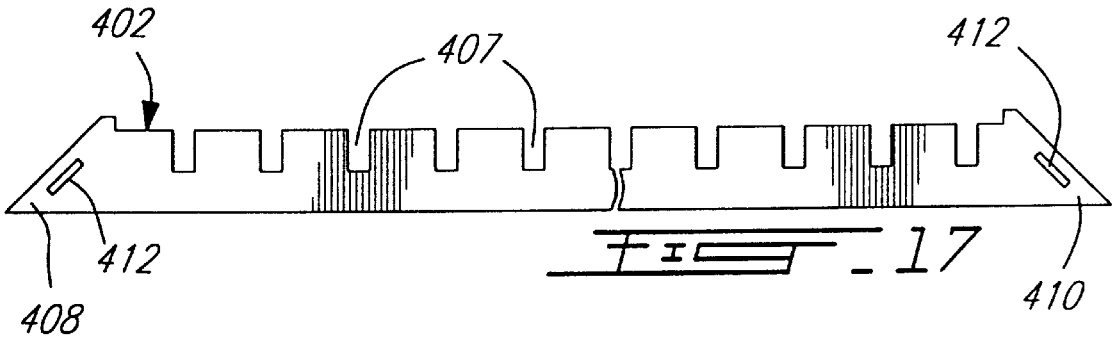
FIG. 17 is a side elevational view of a first support member of the wall mounting assembly of FIG. 14.

As can be better seen from FIG. 17, each first support members 402 includes a plurality of cutouts 407 into which the second support members may be inserted. The first support members also include a pair of bevelled ends 408, 410 each provided with a rectangular aperture 412 to which the frame members 405 are mounted via projecting connecting elements (not shown).

FIGS. 15, 16, 18 and 19 illustrate second support members 404 having different configurations while being connectable to the first support members 402. Each of these second support member 404 includes cutouts 414 configured and sized to be connected to the cutouts 407 of the first support members 402. A lattice of support members is thus formed by the interconnection of a plurality of first and second support members (see FIG. 14). It is also to be noted that the second support members also include a pair of bevelled ends 408, 410 each provided with a rectangular aperture 412 to which the frame members 405 are mounted via projecting connecting elements (not shown)

Figure 15:
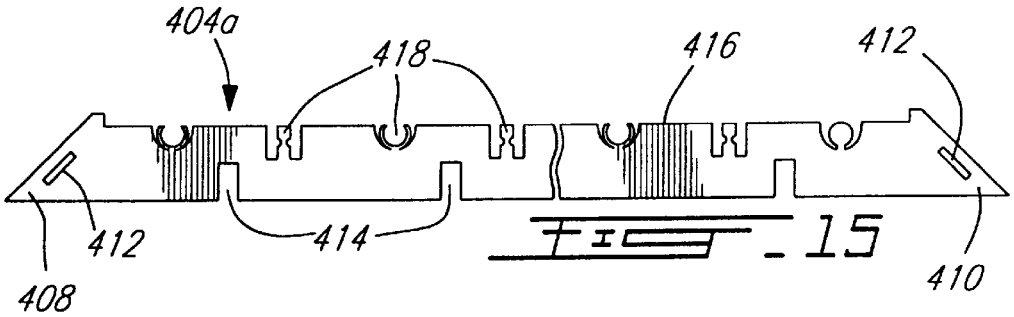
FIG. 15 is a side elevational view of a first embodiment of a second support member of the wall mounting assembly of FIG. 14.

FIG. 15 illustrates a second support member 404*a* having a top surface 416 provided with a plurality of different recessed connecting elements 418 similar to the recessed connecting element described hereinabove with respect to FIG. 10. On the other hand, FIG. 16 illustrates a second support member 404*b* having a top surface 418 provided with only one type of recessed connecting element 420.

Figure 16:
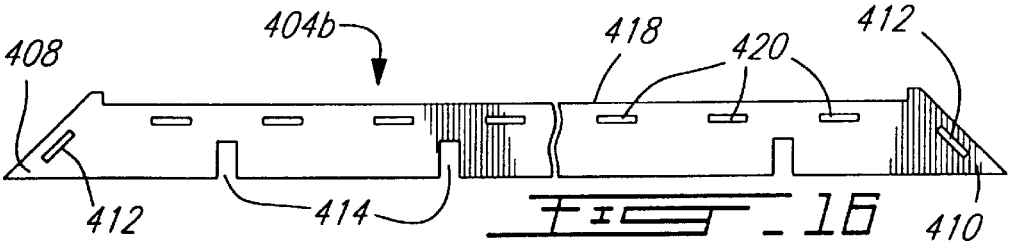
FIG. 16 is a side elevational view of a second embodiment of a second support member of the wall mounting assembly of FIG. 14.
Figure 18:
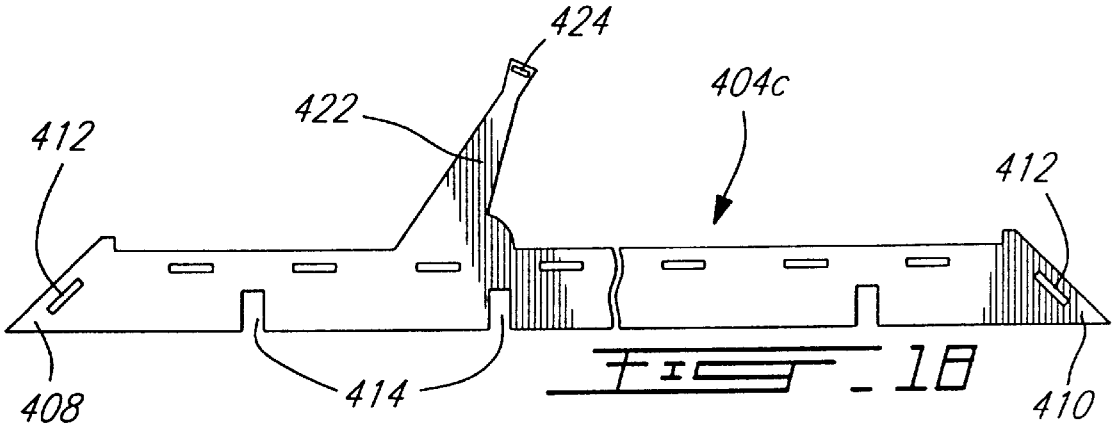
FIG. 18 is a side elevational view of a third embodiment of a second support member of the wall mounting assembly of FIG. 14.
Figure 19:
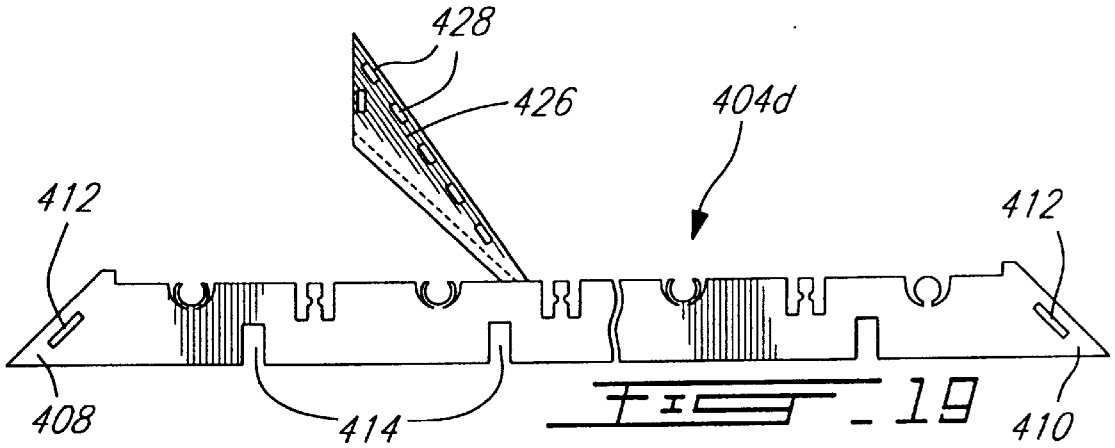
FIG. 19 is a side elevational view of a fourth embodiment of a second support member of the wall mounting assembly of FIG. 14.

The second support member 404*c* illustrated in FIG. 18 is similar to the support member 404*b* of FIG. 16 since only one type of recessed connecting element is provided. The support member 404*c* further includes a three-dimensional puzzle assembly supporting extension 422 provided with a distal end having a recessed connecting element 424 to which a three-dimensional puzzle assembly (not shown) may be removably connected.

Figure 14:
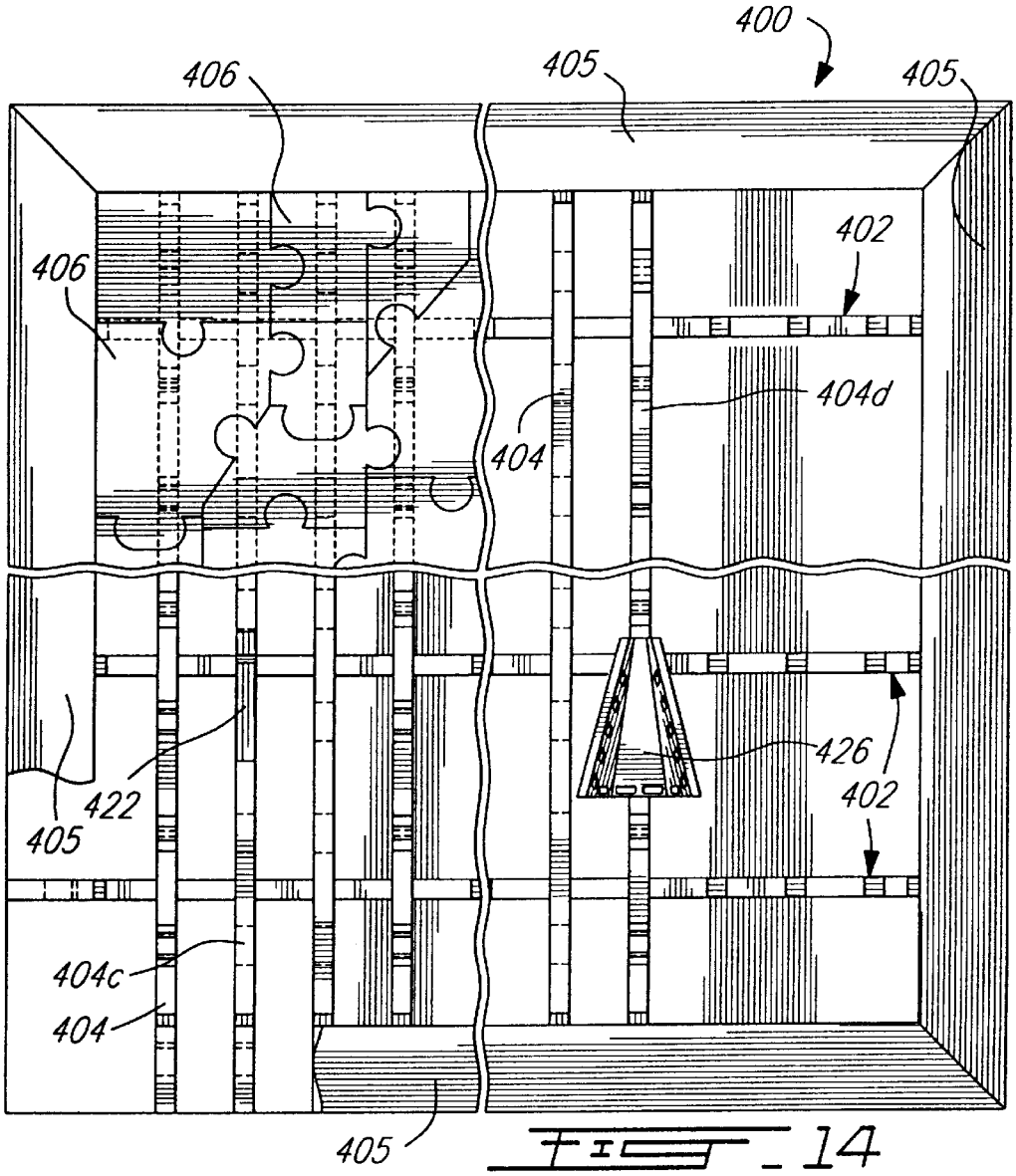
FIG. 14 is a front elevational view of a wall mounting assembly configured to receive the puzzle pieces of FIGS. 13 and/or 14.

The second support member 404*d* illustrated in FIGS. 14 and 18 is similar to the support member 404*a* of FIG. 15 since different types of recessed connecting element are provided. The support member 404*c* further includes a three-dimensional puzzle assembly supporting extension 426 provided with a plurality of recessed connecting elements 428 to which a three-dimensional puzzle assembly (not shown) may be removably connected.

An advantage is that the three-dimensional puzzle of the present invention, once assembled, may be used as a toy since the interconnections between the various structural and puzzle pieces forming the puzzle assembly are sufficiently strong to allow the assembled puzzle to be manipulated without disconnection of the elements.

It is to be noted that the wall mounting assemblies illustrated in FIGS. 4, 5, 7 and 14 could also be mounted to a ceiling, once assembled.

As will be easily understood by one of ordinary skills in the art, the decoration present on the front surface of the puzzle pieces may be painted directly on the puzzle pieces or may be applied to the front surface using a plurality of techniques such as, for example, heat transfer or adhesion.

Although the present invention has been described hereinabove by way of preferred embodiments thereof, it can be modified, without departing from the spirit and nature of the subject invention as defined in the appended claims.

What is claimed is:

1. A three-dimensional puzzle assembly comprising:

a structural portion including a plurality of generally flat structural elements provided with at least one first interconnecting means; said plurality of generally flat structural elements being configured and sized to be interconnected to define a predetermined three-dimensional shape;

a decorative portion including a plurality of generally flat decorative elements made of a resilient material and provided with a front decorative surface and a reverse surface; said reverse surface of each said generally flat decorative element being provided with at least one second interconnecting means; each said second interconnecting means being so configured as to interconnect with one of said first interconnecting means to thereby releasably maintain said generally flat decorative element to said structural element; said resiliency of said generally flat decorative elements allows said decorative elements to be bent as to follow said predetermined three-dimensional shape of said structural portion.

2. A three-dimensional puzzle assembly as recited in claim 1, wherein each said structural element includes structural interconnecting means for interconnecting said plurality of structural elements into said predetermined three-dimensional shape.

3. A three-dimensional puzzle assembly as recited in claim 1, wherein said first interconnecting means include circular apertures.

4. A three-dimensional puzzle assembly as recited in claim 3, wherein said second interconnecting means include at least one cylindrical projection having an external diameter similar in size to said circular aperture to enable the cylindrical projection to snugly fit in said circular aperture.

5. A three-dimensional puzzle assembly as recited in claim 1, wherein said first interconnecting means include recessed connecting elements.

6. A three-dimensional puzzle assembly as recited in claim 5, wherein said second interconnecting means include projecting connecting elements.

7. A three-dimensional puzzle assembly as recited in claim 6, wherein said recessed connecting elements have predetermined shapes and wherein said projecting connecting elements have corresponding interlocking predetermined shapes allowing the projecting connecting elements to interconnect with the recessed connecting elements.

8. A three-dimensional puzzle assembly as recited in claim 1, further comprising a handle element mounted to said structural portion.

9. A kit of parts for forming a three-dimensional puzzle, the kit of parts comprising:

a plurality of generally flat structural elements provided with at least one first interconnecting means; said plurality of generally flat structural elements being configured and sized to be interconnected to define a predetermined three-dimensional shape;

a plurality of generally flat decorative elements made of a resilient material and provided with a front decorative surface and a reverse surface; said reverse surface of each said generally flat decorative elements being provided with at least one second interconnecting means; each said second interconnecting means being so configured as to interconnect with one of said first interconnecting means to thereby releasably maintain said generally flat decorative elements to said structural element; said resiliency of said generally flat decorative elements allows said decorative elements to be bent as to follow said predetermined three-dimensional shape of said structural portion.

10. A kit of parts as recited in claim 9, wherein each said structural element includes structural interconnecting means for interconnecting said plurality of structural elements into said predetermined three-dimensional shape.

11. A kit of parts as recited in claim 9, wherein said first interconnecting means include circular apertures.

12. A kit of parts as recited in claim 11, wherein said second interconnecting means include at least one cylindrical projection having an external diameter similar in size to said circular aperture to enable the cylindrical projection to snugly fit in said circular aperture.

13. A kit of parts as recited in claim 9, wherein said first interconnecting means include recessed connecting elements.

14. A kit of parts as recited in claim 13, wherein said second interconnecting means include projecting connecting elements.

15. A kit of parts as recited in claim 14, wherein said recessed connecting elements have predetermined shapes and wherein said projecting connecting elements have corresponding interlocking predetermined shapes allowing the projecting connecting elements to interconnect with the recessed connecting elements.

16. A kit of parts as recited in claim 9, further comprising a handle element mounted to said structural portion.

17. A wall mounting assembly for supporting a three-dimensional puzzle, said wall mounting assembly comprising:

a structural portion including a plurality of structural elements provided with at least one first interconnecting means; said plurality of structural elements being configured and sized to be interconnected to define a predetermined shape;

a decorative portion including a plurality of generally flat decorative elements made of a resilient material and provided with a front decorative surface and a reverse surface; said reverse surface of each said generally flat decorative element being provided with at least one second interconnecting means; each said second interconnecting means being so configured as to interconnect with one of said first interconnecting means to thereby releasably maintain said generally flat decorative element to said structural element; and means for supporting a three-dimensional puzzle; said support means being mounted to said structural portion and including a distal end to which a three-dimensional puzzle is removably mounted.

18. A wall mounting assembly as recited in claim 17, wherein each said structural element includes structural interconnecting means for interconnecting said plurality of structural elements into said predetermined shape.

19. A wall mounting assembly as recited in claim 17, wherein said first interconnecting means include circular apertures.

20. A wall mounting assembly as recited in claim 19, wherein said second interconnecting means include at least one cylindrical projection having an external diameter similar in size to said circular aperture to enable the cylindrical projection to snugly fit in said circular aperture.

21. A wall mounting assembly as recited in claim 17, wherein said first interconnecting means include recessed connecting elements.

22. A wall mounting assembly as recited in claim 21, wherein said second interconnecting means include projecting connecting elements.

23. A wall mounting assembly as recited in claim 22, wherein said recessed connecting elements have predetermined shapes and wherein said projecting connecting elements have corresponding interlocking predetermined shapes allowing the projecting connecting elements to interconnect with the recessed connecting elements.

* * * * *